US010291992B2

(12) United States Patent
Ochsenbein et al.

(10) Patent No.: US 10,291,992 B2
(45) Date of Patent: May 14, 2019

(54) METHOD OF MOUNTING A HEARING DEVICE COMPONENT INSIDE A HEARING DEVICE

(71) Applicant: SONOVA AG, Staefa (CH)

(72) Inventors: Andre Lucien Ochsenbein, Wolfhausen (CH); Christoph Leist, Rapperswil (CH); Gabriel Perez, Mannedorf (CH)

(73) Assignee: Sonova AG, Stäfa (CH)

( * ) Notice: Subject to any disclaimer, the term of this patent is extended or adjusted under 35 U.S.C. 154(b) by 0 days.

(21) Appl. No.: 15/551,317

(22) PCT Filed: Mar. 3, 2015

(86) PCT No.: PCT/EP2015/054441

§ 371 (c)(1),
(2) Date: Aug. 16, 2017

(87) PCT Pub. No.: WO2016/138946

PCT Pub. Date: Sep. 9, 2016

(65) Prior Publication Data

US 2018/0035218 A1 Feb. 1, 2018

(51) Int. Cl.
*H04R 25/00* (2006.01)

(52) U.S. Cl.
CPC ..... *H04R 25/60* (2013.01); *H04R 25/608* (2013.01); *H04R 25/652* (2013.01); *H04R 2225/025* (2013.01); *H04R 2225/49* (2013.01); *H04R 2225/51* (2013.01); *H04R 2460/17* (2013.01)

(58) Field of Classification Search
CPC .... H04R 25/608; H04R 25/65; H04R 25/652; H04R 25/654; H04R 25/658; H04R 2225/025
See application file for complete search history.

(56) References Cited

U.S. PATENT DOCUMENTS

| | | | | |
|---|---|---|---|---|
| 2007/0086610 | A1* | 4/2007 | Niederdrank ..... | H01Q 1/273 381/312 |
| 2011/0142270 | A1 | 6/2011 | Niederdrank | |
| 2012/0033840 | A1 | 2/2012 | Goly | |
| 2015/0047960 | A1* | 2/2015 | Davis ..... | H01H 13/14 200/52 R |

FOREIGN PATENT DOCUMENTS

| | | | |
|---|---|---|---|
| EP | 2 615 854 | A1 | 7/2013 |
| WO | 00/70911 | A1 | 11/2000 |

* cited by examiner

*Primary Examiner* — Sunita Joshi

(57) ABSTRACT

Provided is a method of mounting at least one hearing device component (14) inside a hearing device shell (12). Said method comprises the steps of threading a fixture means (16) through a hole (18) formed in the wall of the hearing device shell (12) and attaching the hearing device component (14) to the end of the portion of the fixture means (16) protruding into the inside of the hearing device shell (12). The method further comprises manipulating the portion of the fixture means (16) protruding to the outside of the hearing device shell (12) such to position the hearing device component (14) in a predetermined position, and fixing the positioned hearing device component (14) to the inner wall of the hearing device shell (12).

20 Claims, 3 Drawing Sheets

METHOD OF MOUNTING A HEARING DEVICE COMPONENT INSIDE A HEARING DEVICE

CROSS-REFERENCE TO RELATED APPLICATIONS

This utility patent application claims the priority date and benefit of International Application Number PCT/EP2015/054441 filed on Mar. 3, 2015.

TECHNICAL FIELD

The present invention is related to a method of mounting at least one hearing device component inside a hearing device shell as well as a hearing device.

BACKGROUND OF THE INVENTION

Hearing devices are typically small ear-level devices used to improve the hearing capability of the hearing impaired people. This is achieved by picking up the surrounding sound with a microphone of a hearing device, processing the microphone signal thereby taking into account the hearing impairment of the user of the hearing device and providing the processed sound signal into an ear canal of the user via a miniature loudspeaker, commonly referred to as a receiver. One of hearing device types is the so-called in the ear hearing device to be worn inside the ear canal of the user. This hearing device comprises a hearing device shell formed and shaped such to conform to the ear canal geometry of the respective user or rather customer. The hearing device shell accommodates components of the hearing device comprising a processor, a battery, at least one microphone, a receiver, a sensor and an antenna, for example. A faceplate is typically used in order to terminate the hearing device shell to the outer environment. Typically, the faceplate is provided with the at least one microphone, a battery door used to replace the battery or to allow for maintenance, etc. but many further components as well. The positioning of components to each other such to allow for proper distances and orientation or rather alignment to each other is difficult. Hence, interferences to each other is a problem.

Document WO 02/078233 proposes to position and support a plurality of components to the inner surface of a faceplate of a hearing device. This technique disadvantageously requires a large faceplate in order to accommodate the plurality of components. However, the increase size of the faceplate contradicts efforts to reduce the scale of hearing devices. Said document further proposes to mount a receiver to a hole of a sound output via a wax filter. However, mounting the receiver to the sound output hole via the wax filter delimits positioning degree of freedom of the receiver inside the shell.

Document U.S. Pat. No. 8,180,085 proposes to use posts or breakable bars in order to keep floating components in place during manufacturing. The spacers can be used to position components, for example components adjacent to each other, in a fixed relationship. However, such spacers are confined to respective functions and are delimited to respective properties or rather characteristics, size, etc. Known techniques require increased number of additional means for the positioning of the components, which renders the known techniques costly, complex and time consuming, at least in the course of manufacturing.

The requirement for customization is especially true for individual geometry of each ear canal. Due to the individual (customized) nature of hearing devices, known techniques propose to position and mount or rather fix a plurality of components to the faceplate. However, this results to the faceplate increases in size. Further, volume inside the hearing device shell remains unused. This results to voids formed inside the hearing device shell, which voids contradicts efforts made in the recent years in hearing device technology in order to minimize hearing device sizes.

It is therefore an object of the present invention to provide a method of mounting at least one hearing device component inside a hearing device shell omitting disadvantages in the prior art. It is further object of the present invention to propose a hearing device comprising a hearing device shell and at least one hearing device component mounted inside said hearing device shell according to the inventive method.

SUMMARY OF THE INVENTION

The present invention is directed to a method of mounting at least one hearing device component inside a hearing device shell. Said method comprises the steps of threading a fixture means through a hole formed in the wall of the hearing device shell, attaching the hearing device component to the end of the portion of the fixture means protruding into the inside of the hearing device shell, manipulating the portion of the fixture means protruding to the outside of the hearing device shell such to position the hearing device component in a predetermined position, and fixing the positioned hearing device component to the inner wall of the hearing device shell.

The inventive method allows for proper positioning of a plurality of hearing device components inside the hearing device shell of a variety of different hearing devices, in particular hearing devices worn inside the ear canal, such as in-the-ear hearing aids, radio devices, etc. It is to be noted that the term "component" as used herein refers to a single component, a group of components, a device, a module, an assembly, a subassembly and/or a combination thereof, without being delimited thereto. According to the method of the present invention, respective components are positioned such to be spaced apart from each other such to mitigate or rather eliminate interference. Besides proper positioning of respective components in relation to each other, said components can be oriented or rather aligned in relation to other components or rather "interferer" such to mitigate or rather eliminate interference.

The importance of proper orientation or rather alignment of components is especially true in view of an antenna or rather antenna coil as one of a plurality of components being sensitive to interference. Especially, having regard to hearing devices worn into the ear canal, individualization or rather customization is very important in view of different sizes of mechanical or electrical components or in view of functions of said components, for example different individual receivers, etc.

According to the present invention, fixing the positioned hearing device component to the inner wall of the hearing device shell allows to substantially reduce the number of components used to be fixed to the faceplate. This reduction in the number of components advantageously allows reduction in the size of the faceplate. In turn, this reduction in the size of the faceplate allows reduction in the size of the hearing device as a whole. The inventive method further provides increased degree of freedom having regard to fixing positions of individual components inside the hearing device shell. Therefore, at least one component acting as interferer ("source") and at least one another component ("drain") being sensitive to interference can be positioned and fixed in relation to each other such to assume maximum distance between each other. For example, the receiver and the antenna are required to be spaced apart such that the distance thereof is maximum due to the interfering fields of the receiver, which interfering fields affect the (sensitive) antenna characteristics. This requirement is achieved by the present invention.

In a further embodiment of the proposed method said hole is modelled and created during a digital shell manufacturing process. Examples of hole manufacturing processes comprise drilling, 3D-modelling and Rapid Shell Modelling (RSM) method while not being delimited thereto. The hole is modelled in a sidewall portion of the hearing device shell. The term "sidewall portion" refers to a portion of the hearing device shell being in contact with the user's ear canal wall if worn by the user.

In a further embodiment of the proposed method the step of fixing comprises applying adhesive. Hence, the at least one component is glued to the inner wall of the hearing device shell. In order to enable gluing the component in a predetermined position, the respective component is positioned beforehand in the predetermined position by means of the fixture means. As mentioned above, the fixture means supports the component attached to the end of the portion of the fixture means protruding into the inside of the shell. Subsequent to the step of positioning, the step of applying adhesive is performed. The step of applying adhesive comprises applying adhesive in a region between said at least one component and the inner wall of the hearing device shell. In other words, the adhesive is applied to a region between the component and the inner wall of the hearing device shell. It is to be noted that as least in the context of the invention the step of applying adhesive also comprises curing said adhesive in dependence on the type of adhesive used.

In a further embodiment the proposed method further comprises the step of cutting off the portion of the fixture means protruding to the outside of the hearing device shell. Subsequent to the adhesive applying step, the portion of the fixture means protruding to the outside of the shell is cut-off. This cutting off step can be performed such that the cut-off plane of the remainder of the fixture means is substantially flush with the outer wall of the hearing device shell. Hence, a distal end of the (remaining) fixture means still penetrates through at least a part of the hole in axial direction thereof. It is to be noted that the term "penetrates" as meant herein, refers to a distal end portion of the fixing means running inside the hole in a substantially axial direction thereof.

Moreover, the present invention is directed to a hearing device comprising a hearing device shell accommodating at least one hearing device component, and a fixture means holding the at least one hearing device component, wherein the fixture means penetrates through a hole formed in the wall of the shell. Hence, provided is a hearing device achieving improved or rather efficient utilization of its interior volume. The reason for this is that a plurality of hearing device components are positioned and fixed individually in a customized way. Further, since the components are fixed to the inner wall of the hearing device shell, the necessity of fixing respective components to the faceplate is omitted. Therefore, a hearing device is achieved which is reduced in size.

In a further embodiment the hearing device further comprises a spacer, wherein said spacer provides a spaced apart positional relationship between the hearing device component and the hearing device shell or between the hearing device component and a further hearing device component. For example, at least one component sensitive to interference, for example an antenna, and at least one further component acting as interferer, for example a receiver, can be positioned and fixed inside the hearing device shell such that the distance thereof becomes maximal as possible. Further, orientation of at least one component can be adjusted such to increase functionality and/or effectiveness. Hence, a hearing device is achieved involving reduced effects of interference, increased reception characteristics, less noise, etc. Therefore, interferences affecting at least one of said components can be mitigated or rather eliminated.

In a further embodiment of the proposed hearing device the hole is positioned in a portion of the hearing device shell resting against a wall of the ear canal of a user if the hearing device is worn by the user. The term "a portion of the shell resting against a wall of the ear canal of a user if the hearing device is worn by the user" refers to portions of the hearing device shell commonly referred to as "sidewall of the shell". The provision or rather creation of the hole in the sidewall of the shell allows for proper positioning of the hearing device component inside the shell in a desired position. As mentioned above, after positioning and fixing the component inside the shell are accomplished, the at least one hole can be closed or rather sealed.

In a further embodiment of the proposed hearing device the fixture means comprises a filament. The filament has a predetermined elasticity in order to allow for proper positioning of the attached hearing device component. The diameter of the filament can be chosen such to allow for proper threading thereof through the hole formed in the wall of the shell. The diameter of the filament is in the range of approximately 0.2 to 2 mm, for example.

In a further embodiment of the proposed hearing device the filament is made of plastic material. The material of the filament should be chosen such to allow for maximum stability thereof even if its diameter is reduced. Further, the filament can show desired elasticity in order to allow for best positioning of the affixed hearing device component inside the hearing device shell in a predetermined position.

In a further embodiment of the proposed hearing device, the hearing device component comprises at least one of a coil, an antenna, a microphone, a processor, a receiver and a sensor. The at least one coil can comprise an antenna, a T-coil, a charging coil, etc. The at least one sensor can be adapted to sense temperature, acceleration, magnetic fields, vibrations, etc. It is to be noted that the term "hearing device component" as used herein refers to an assembly, a subassembly, a group, etc. while not being delimited thereto. In an example, at least two components can be integrated such to form an assembly, subassembly, group, etc.

These and further objects, features and advantages of the present invention will become apparent from the following description when taken in connection with the accompanying drawings which, for purposes of illustration only, show several embodiments in accordance with the present disclosure.

BRIEF DESCRIPTION OF THE DRAWINGS

The present invention is further described with reference to the accompanying drawing jointly illustrating various exemplary embodiments which are to be considered in connection with the following detailed description. What is shown in the figures is.

DETAILED DESCRIPTION OF THE INVENTION

Figure 1:
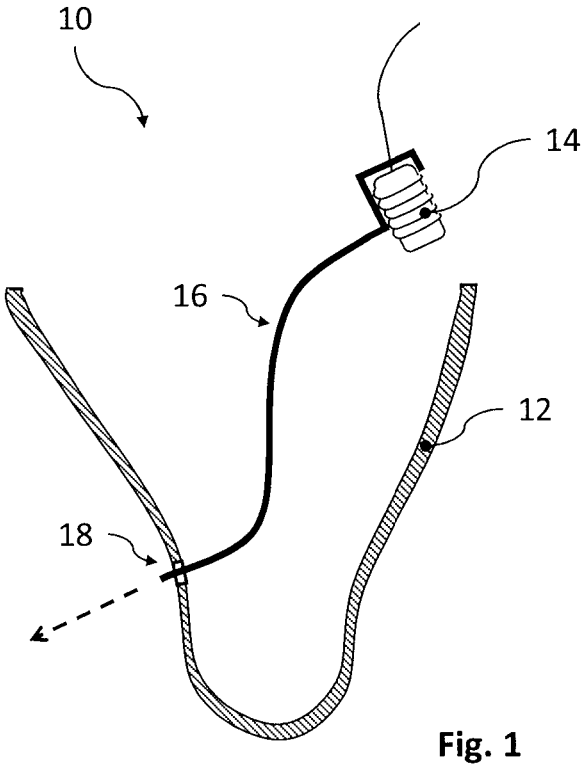
FIG. 1 depicts a method of mounting a hearing device component inside a hearing device shell according to the present invention.

FIG. 1 shows a cross-sectional view of a hearing device 10 taken along the length direction thereof. The hearing device 10 comprises a hearing device shell 12 depicted in hatched lines. The hearing device shell 12 is modelled such to substantially conform to the ear canal geometry of a user. FIG. 1 exemplary illustrates the inventive method of mounting a hearing device component 14 inside the hearing device shell 12. An antenna 14 is used to exemplify one of a plurality of hearing device components. While not shown, the hearing device component can be exemplified by further components, means, elements, etc., for example a coil, a microphone, a receiver, a processor, a sensor, etc. The antenna 14 is attached to an end of a portion of a fixture means 16, which portion protrudes into the inside of the hearing device shell 12. The fixture means 16 is threaded through a hole 18 created in the wall of the hearing device shell 12. The method further comprises manipulating the portion of the fixture means 16 protruding to the outside of the hearing device shell 12 such to position the antenna 14 in a predetermined position. By pulling the fixture means 16 (as indicated in the FIG. 1 by an arrow), the antenna 14 is positioned inside the hearing device shell 12 in a predetermined position. Advantageously, the exact orientation of the antenna 14 is corrected by applying a torsional force to the fixture means 16, if necessary.

Figure 2:
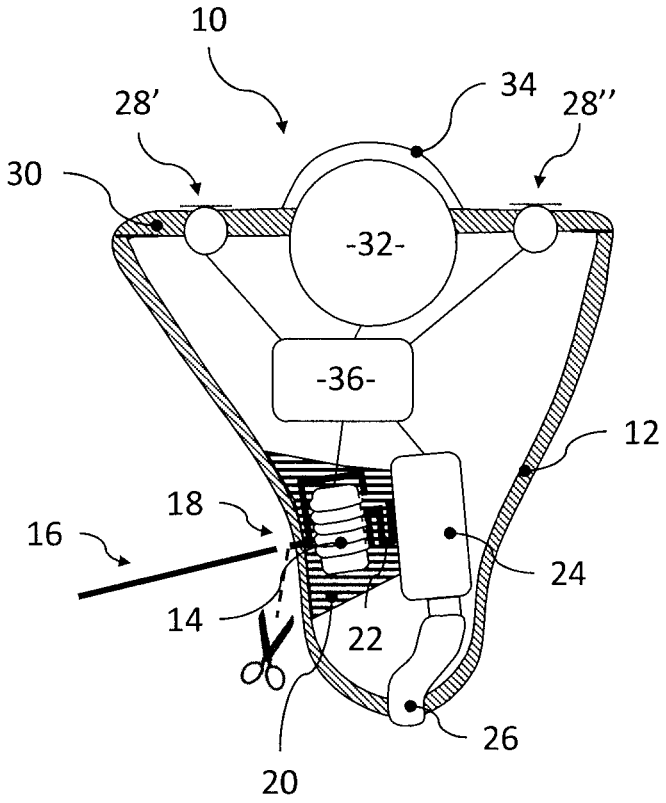
FIG. 2 is a schematic view illustrating the hearing device component fixed to the inner wall of the hearing device shell according to the method of the present invention.

Subsequently, the antenna 14 is fixed to the inner wall of the hearing device shell 12 by means of a fixing step as best shown in FIG. 2. The step of fixing the antenna 14 to the inner wall of the hearing device shell 12 comprises applying adhesive 20. In particular, adhesive 20 is applied to the antenna 14 such to glue the antenna 14 to at least the inner wall of the hearing device shell 12. Further, as shown in FIG. 2, a spacer 22 is interposed between the antenna 14 and a further hearing device component exemplified by a receiver 24. Said spacer 22 is interposed such to provide a spaced apart positional relationship between the antenna 14 and the receiver 24. Hence, influences caused by interferences can be reduced substantially. While not shown, at least one further spacer can be sandwiched between the antenna 14 and the inner wall of the hearing device shell 12 such to provide a spaced apart positional relationship between the antenna 14 and the hearing device shell 12.

The hole 18 is created/modelled in the sidewall of the hearing device shell 12. In particular, the hole 18 is disposed such to allow for proper positioning and fixing the antenna 14 in a lower portion of the hearing device shell 12, for example, as indicated in the FIG. 2. Hence, the inner space of the hearing device shell 12 is utilized efficiently. Therefore, voids (i.e. unused volumes into the hearing device shell 12) can be reduced or rather eliminated, resulting in reduced size of the hearing device 10 as a whole.

Once the adhesive 20 is cured, the fixture means 16 can be cut off. To be more precise, the portion of the fixture means 16 protruding to the outside of the shell 12 is cut off from the remainder portion of the fixture means (i.e. at least a portion of the fixture means extending into the hole 18) as schematically indicated by a scissors. The hearing device 10 further comprises a sound tube 26 interposed between an output of the receiver 24 and a sound output port of the hearing device 10. Further, microphones 28', 28" are disposed on and fixed to the inner surface of a faceplate 30. The term "inner surface of a faceplate" refers to the surface of the faceplate facing the interior of the hearing device shell 12. Further comprised is a battery 32, which can be easily replaced with a new battery by means of opening/closing a door 34 hinged to the outer surface of the faceplate 30. As schematically depicted in the FIG. 2, a plurality of the hearing device components mentioned above are electrically connected to a processor 36 by means of wirings. The processor 36 is at least adapted to input/output control of respective operationally connected components.

As shown in the FIG. 2, the antenna 14 is fixed to the inner wall of the hearing device shell 12 while the receiver 24 is fixed to the antenna 14 as well as to the inner wall of the hearing device shell 12, too. Fixture is attained by means of the adhesive 20. Further, the antenna 14 and the receiver 24 are spaced apart from each other by means of the spacer 22 being sandwiched between the antenna 14 and the receiver 24. While not shown, further hearing device components can be fixed to respective portions of the inner wall of the hearing device shell 12 and/or can be fixed to further components of the plurality of the hearing device components. For example, the processor 36 can be fixed to the inner wall of the hearing device shell 12 by the inventive mounting method.

The antenna 14 and receiver 24 are shown fixed to the inner wall of the hearing device shell 12 locally. This method of fixing provides for increased flexibility. However, while not shown, a plurality or rather all hearing device components can be integrally fixed to each other by adhesive. In other words, subsequent to proper positioning of a plurality of hearing device components, the hearing device shell 12 can be filled with adhesive. This aspect of fixing the positioned hearing device components provides for increased stability and sealing while (local) flexibility is impaired.

Figure 3:
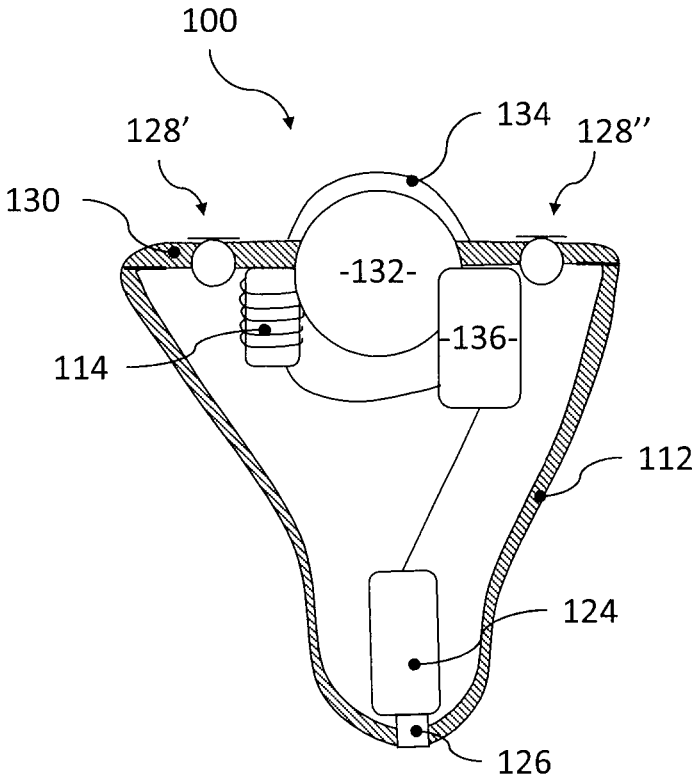
FIG. 3 is a schematic view illustrating hearing device components fixed to a hearing device shell according to the prior art.

FIG. 3 schematically shows a cross-sectional view of a hearing device 100 comprising hearing device components fixed according to the prior art. The hearing device 100 comprises a hearing device shell 112 confining the hearing device 100 interior. An antenna 114 as well as two microphones 128', 128", which are exemplifying ones of a plurality of hearing device components, are shown fixed to an inner surface of a faceplate 130. The faceplate 130 terminates the hearing device 100 interior to the outside. Further, a receiver 124 is fixed to the hearing device shell 112 via a sound tube 126. The sound tube 126 penetrates through an sound output port of the hearing device shell 112 on a first end side and is fixed to an output of the receiver 124 on a second end side. A battery 132 is mounted to the hearing device 100 by means of a battery support (not shown). Replacement of the battery 132 can be accomplished by opening a battery door 134 hinged to an outer surface of the faceplate 130. Further, a processor 136 is positioned and fixed to the inner surface of the faceplate 130 as well.

According to the prior art as exemplary shown in FIG. 3, the inner surface of the faceplate 130 facing towards the interior of the hearing device shell 112 acts as supporting means used to provide support for a large number of further hearing device components, for example the antenna 114, the processor 136, etc. In other words, in the prior art, while not shown, a huge plurality of hearing device components are fixed to and supported by the faceplate 130. In the prior art, since the faceplate 130 is used as supporting means, the faceplate 130 assumes an increased size. In other words, the necessity to support the large number of hearing device components, inevitably results to increased size of the faceplate 130. Disadvantageously, the increased size of the faceplate 130 results to increased size of the hearing device 100 as a whole. This in turn results to in the hearing device 100 according to the prior art does not fit into all ear canals. Further, resulting from the dense packaging of the hearing device components on the inner surface of the faceplate 130, performances of some hearing device components are inferior due to interferences among each other.

What is claimed is:

1. A method of mounting at least one hearing device component inside a hearing device shell, the method comprises the steps of:

threading a first end of a filament through a hole formed in a side wall of the hearing device shell;

attaching the hearing device component to the first end of the filament protruding into an inside cavity formed by the hearing device shell;

manipulating filament to position the hearing device component in a predetermined position in the inside cavity of the hearing device shell;

fixing the positioned hearing device component to an inner surface of the side wall of the hearing device shell;

cutting off a portion of the filament protruding outside of the hearing device shell, such that a second end of the filament resulting from the cutting of the filament penetrates into at least a part of the hole; and sealing the hole, wherein sealing the hole comprises attaching the second end of the filament still penetrating into the hole with the sealed hole.

2. The method according to claim 1, wherein the hole is created during a digital shell manufacturing process.

3. The method according to claim 1, wherein the step of fixing the positioned hearing device component comprises applying adhesive to the positioned hearing device component.

4. A hearing device comprising:

a hearing device shell forming a cavity accommodating a hearing device component;

filament holding the hearing device component inside the cavity, wherein the filament comprises:

a first end that penetrates through at least a part of a hole formed in a side wall of the hearing device shell and is sealed within the hole;

a second end that is attached to the hearing device component; and a spacer, wherein the spacer provides a spaced apart positional relationship between the hearing device component and the hearing device shell or between the hearing device component and another hearing device component.

5. The hearing device according to claim 4, wherein the hole is positioned in a portion of the hearing device shell which in use rests against a wall of an ear canal of a user when the hearing device is worn by the user.

6. The hearing device according to claim 4, wherein the first end of the filament is substantially flush with an outer surface of the hearing device shell.

7. The hearing device according to claim 4, wherein the filament is made of a plastic material.

8. The hearing device according to claim 4, wherein the hearing device component comprises at least one of a coil, an antenna, a microphone, a processor, a receiver, and a sensor.

9. The method according to claim 3, wherein the hearing device shell is filled with the adhesive.

10. The method according to claim 1, wherein the filament comprises a plastic material.

11. The method according to claim 1, wherein the predetermined position is in a lower portion of the hearing device shell distal from an opening in the cavity formed by the hearing device shell.

12. The method according to claim 11, further comprising attaching a faceplate to the hearing device shell to close an opening.

13. The method according to claim 1, wherein attaching the second end of the filament still penetrating into the hole with the sealed hole comprises sealing the hole such that the second end is sealed in place in the hole.

14. The hearing device according to claim 4, wherein the filament has a diameter in a range of approximately 0.2 to 2 millimeters.

15. The hearing device according to claim 4, wherein the cavity comprises an opening and the hearing device further comprises a faceplate configured to close an opening and separate the cavity formed by the hearing device shell from an outside.

16. A method of positioning a hearing device component in a hearing device shell, the method comprising:

threading a first end of a filament through a hole formed in a side wall of the hearing device shell;

attaching the hearing device component to the first end of the filament protruding into an inside cavity formed by the hearing device shell;

manipulating filament to position the hearing device component in a position in the inside cavity of the hearing device shell;

fixing the positioned hearing device component to an inner surface of the side wall of the hearing device shell; and attaching the second end of the filament still penetrating into the hole with the sealed hole comprises sealing the hole such that the second end is sealed in place in the hole.

17. The method of claim 16, wherein the hole is created during a digital shell manufacturing process.

18. The method of claim 16, wherein fixing the positioned hearing device component comprises applying adhesive to the positioned hearing device component.

19. The method of claim 16, wherein the filament has a diameter in a range of approximately 0.2 to 2 millimeters.

20. The method according to claim 16, further comprising attaching a faceplate to the hearing device shell to close an opening.

* * * * *